US005207072A

United States Patent [19]

Arno et al.

[11] Patent Number: 5,207,072

[45] Date of Patent: May 4, 1993

[54] UNLOADING STRUCTURE FOR COMPRESSOR OF REFRIGERATION SYSTEM

[75] Inventors: Raymond P. Arno, Amherst; Scott C. Carnes, Buffalo, both of N.Y.

[73] Assignee: Rayco Enterprises, Inc., Buffalo, N.Y.

[21] Appl. No.: 767,237

[22] Filed: Sep. 27, 1991

Related U.S. Application Data

[63] Continuation-in-part of Ser. No. 652,309, Feb. 6, 1991, abandoned, which is a continuation-in-part of Ser. No. 490,340, Mar. 8, 1990, abandoned.

[51] Int. Cl.[5] ..... F25B 41/00

[52] U.S. Cl. ..... 62/196.3; 62/228.5; 62/513

[58] Field of Search ..... 62/196.3, 513, 228.5

[56] References Cited

U.S. PATENT DOCUMENTS

| | | | |
|---|---|---|---|
| 2,363,273 | 11/1944 | Waterfill | 62/196.3 X |
| 2,739,451 | 3/1956 | Breck | 62/196.3 X |
| 3,201,950 | 8/1965 | Shrader | 62/513 X |

FOREIGN PATENT DOCUMENTS

| | | | |
|---|---|---|---|
| 54-37946 | 3/1979 | Japan | 62/196.4 |

*Primary Examiner*—William E. Wayner

*Attorney, Agent, or Firm*—Joseph P. Gastel

[57] ABSTRACT

A refrigeration system including a compressor, condenser, thermal expansion valve, control for the thermal expansion valve, shell evaporator, suction line between the shell evaporator and compressor, and a control evaporator in the suction line between the shell evaporator and the control for the thermal expansion valve utilizing hot refrigerant gas from the compressor to heat the refrigerant in the suction line. The refrigeration system also includes an unloading arrangement for the compressor. In one arrangement a hot loop circuit is located directly between the outlet of the compressor and the inlet thereof and a cold loop circuit is located between the outlet and inlet of the compressor and which includes the evaporator, and both loops bypass the condenser and thus pass refrigerant from the compressor back to the compressor to thereby permit it to selectively operate in an unloaded condition in response to the load applied by the medium which is being cooled. An alternate and preferred arrangement for unloading the compressor includes a loop circuit between the outlet of the compressor and the inlet thereof which passes through an auxiliary evaporator under the main evaporator to thereby bypass the condenser and thus unload it in response to the load applied by the medium being cooled.

22 Claims, 4 Drawing Sheets

UNLOADING STRUCTURE FOR COMPRESSOR OF REFRIGERATION SYSTEM

CROSS REFERENCE TO RELATED APPLICATION

This application is a continuation-in-part of application Ser. No. 652,309, filed Feb. 6, 1991, now abandoned, which is a continuation-in-part of application Ser. No. 490,340, filed Mar. 8, 1990, now abandoned.

BACKGROUND OF THE INVENTION

The present invention relates to a refrigeration system which includes structure for unloading its compressor while permitting it to continue in operation by passing hot gas from its outlet to its inlet in various ways.

In the past, there were various ways of unloading a hermetic compressor when refrigeration was not required, and such methods included cycling the compressor on and off and by bypassing compressor discharge refrigerant directly into the suction line. Thus hermetic compressors were controlled in the past either by cycling the compressor on and off in response to demand or providing an artificial load with a discharge bypass valve equal to the difference between the real load and the systems capacity. Other methods included the use of pressure regulators and liquid or suction line solenoid valves controlled with thermostats. However, the various prior systems were undesirable in that they either constituted a waste of power or did not provide precise control or they involved the risk of oil starvation to the compressor.

SUMMARY OF THE INVENTION

It is the object of the present invention to provide improved systems for unloading a hermetic compressor while permitting it to continue to run without wasting excess power and without involving the risk of oil starvation to the compressor.

Another object of the present invention is to provide an improved system for unloading a hermetic compressor while permitting it to run without wasting excess power and without the risk of oil starvation and without the possibility of liquid flow of refrigerant to the compressor which could damage it. Other objects and attendant advantages of the present invention will readily be perceived hereafter.

The present invention relates to a refrigeration system comprising a compressor having a compressor outlet and an inlet, a condenser, first conduit means coupling said compressor outlet to said condenser, an evaporator, second conduit means coupling said condenser to said evaporator, refrigerant expansion means in said second conduit means, third conduit means coupling said evaporator to said inlet of said hermetic compressor, refrigerant and oil circulated through said system by said compressor, and unloading means for unloading said compressor without overheating while permitting it to continue running, said unloading means comprising fourth conduit means coupled between said first conduit means and said compressor inlet for passing hot gas from said compressor back to said compressor inlet, cooling means for cooling said hot gas in said fourth conduit means to thereby cool said hot gas passing into said compressor inlet from said fourth conduit means, and control means for selectively effecting passage of gases from said compressor through said fourth conduit means in response to the necessity for unloading said compressor to cause said refrigeration system to stop producing refrigeration.

In accordance with the preferred embodiment of the present invention the compressor is unloaded by passing hot gas from the outlet of the compressor to its inlet through a loop which includes an auxiliary evaporator which is associated with the main evaporator. In accordance with another embodiment of the present invention the compressor is unloaded by utilizing a hot loop for passing hot gas from the compressor outlet directly to its inlet and a cold loop for passing hot gas from the compressor outlet through the main evaporator and then into mixing relationship with the hot gas in the hot loop to cool it prior to the passage of the hot gas back to the compressor inlet.

The various aspects of the present invention will be more fully understood when the following portions of the specification are read in conjunction with the accompanying drawings wherein:

DESCRIPTION OF THE PREFERRED EMBODIMENTS

Figure 1:
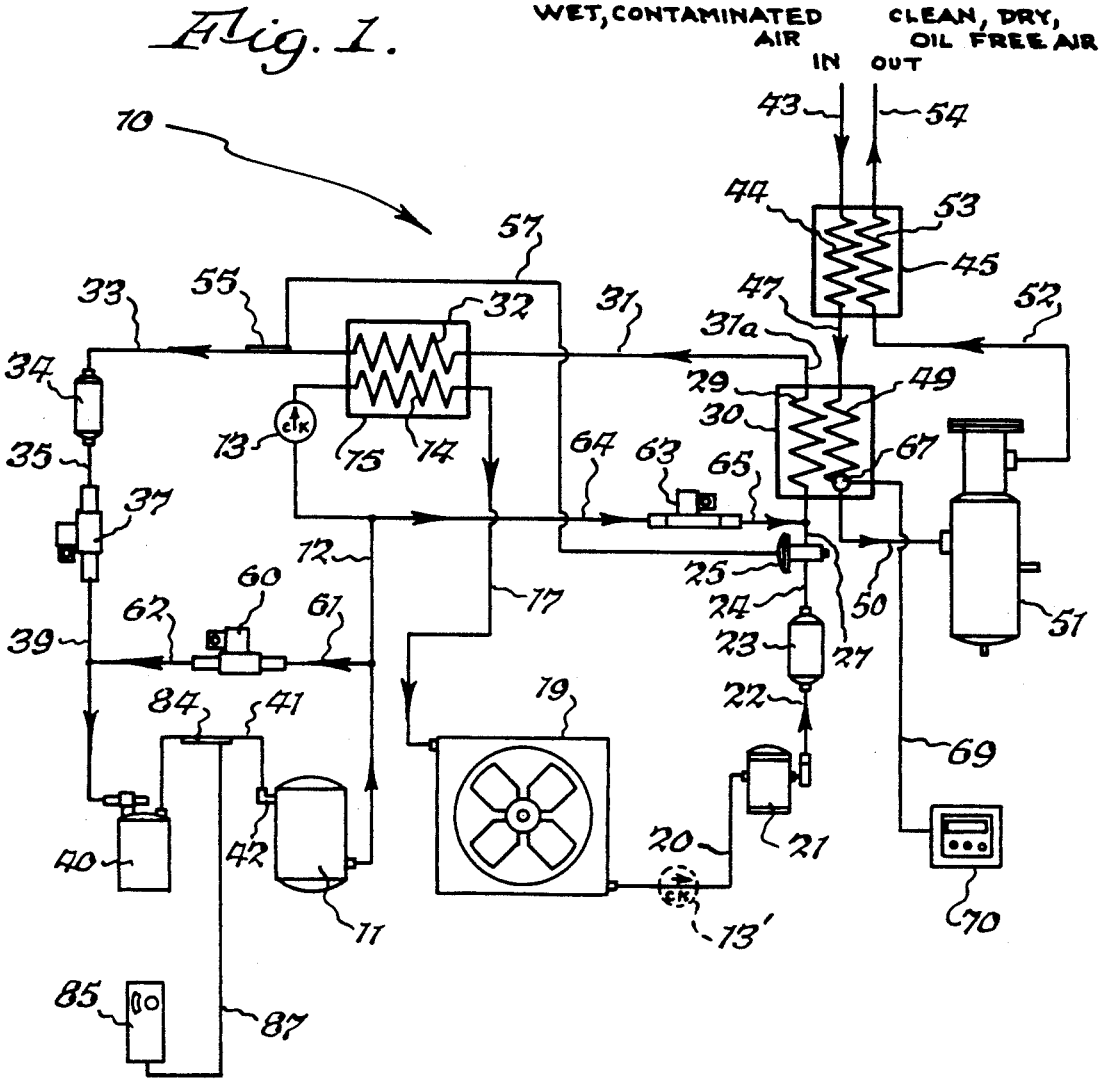
FIG. 1 is a schematic view of a refrigeration system for an air dryer containing structure for maintaining a shell evaporator fully flooded and for unloading the compressor while permitting it to run when the air which is being dried is below a predetermined temperature.

By way of brief background, the refrigeration system of the present invention is intended to be used with an air dryer, but it has other uses also. The major aspect of the present invention is to provide arrangements for unloading a hermetic compressor of a refrigeration system while permitting it to continue to run, thereby obviating the necessity for cycling the compressor in response to load or using other unloading procedures. In the present disclosure the unloading arrangements are shown as used in a refrigeration system wherein a shell evaporator operates in fully flooded condition to thereby ensure the passage of liquid refrigerant and entrained oil therefrom and also ensures that the liquid refrigerant is fully vaporized prior to entry into the compressor to thereby prevent what is known as "slugging" or "flood-back." However, the systems need not be used with flooded evaporators. The unloading arrangements are also shown in conjunction with a specific control arrangement for controlling the unloading of the hermetic compressor, but other controls can be used.

The improved refrigeration system 10 of FIGS. 1–5 includes a hermetic compressor 11 for compressing a halocarbon refrigerant and passing it with entrained oil into conduit 12 through check valve 13, heat exchange conduit 14 of control evaporator 15, and conduit 17 to condenser 19 wherein the refrigerant is condensed in the conventional manner. The function of control evaporator 15 will be described at an appropriate point hereafter. Conduit 12, check valve 13, conduit 14, and conduit 17 are to be collectively considered as the conduit between the compressor 11 and condenser 19.

Figure 3:
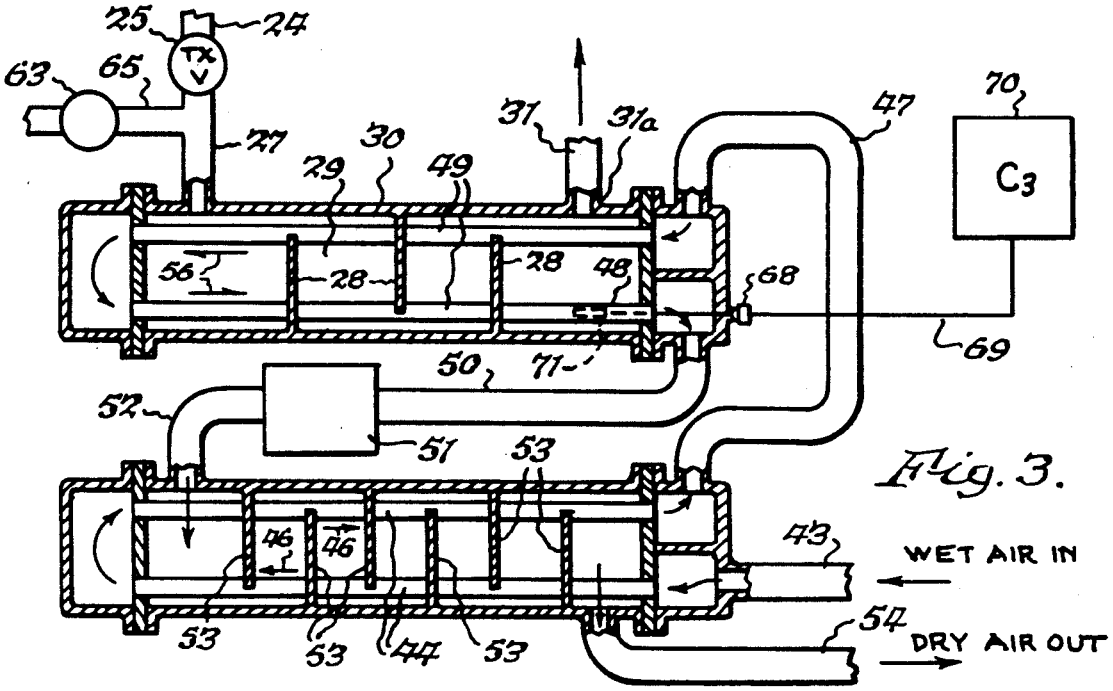
FIG. 3 is a fragmentary schematic view of a flooded evaporator used with an air dryer and showing various components of FIGS. 1 and 2 thereon.
Figure 4:
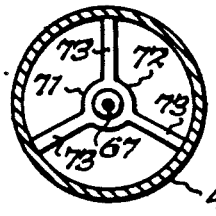
FIG. 4 is a cross sectional view taken substantially along line 4—4 of FIG. 3 and showing the combined plug and thermocouple structure for controlling the compressor unloading structure of FIGS. 1 and 2.

The liquified refrigerant with entrained oil therein leaving condenser 19 passes into conduit 20 and then into receiver 21 from which it passes into conduit 22 and then through dryer 23, conduit 24, thermal expansion valve 25 and conduit 27 into the inside 29 of shell evaporator 30 and it then passes around baffles 28 in traveling from inlet conduit 27 to outlet conduit 31. The shell evaporator 30 is a conventional device well known in the field, and it is schematically shown in FIGS. 1 and 3. Conduit 20, receiver 21, conduit 22, dryer 23, conduit 24, and conduit 27 are to be collectively considered as the conduit between the compressor 19 and shell evaporator 30. Check valve 13 prevents back flow of liquid refrigerant from the condenser 19 and the receiver 20. Alternatively, a check valve such as 13' may be installed in conduit 20 between condenser 19 and receiver 21 to prevent back flow from receiver 21, as shown in both FIGS. 1 and 6.

The refrigerant leaving conduit 29 of shell evaporator 30 passes into conduit 31, through heat exchange conduit 32 of control evaporator 15, conduit 33, suction line filter dryer 34, conduit 35, suction line solenoid valve 37, conduit 39, suction accumulator 40, and conduit 41, into the inlet 42 of compressor 11. All of the above enumerated components between heat exchange conduit 29 and inlet 42, that is, components 31, 32, 33, 34, 35, 37, 39, 40 and 41 are to be considered collectively as the suction line of the system.

As noted briefly above, the present refrigeration system, by way of example and not of limitation, is used in conjunction with an air dryer wherein refrigeration is utilized to remove moisture from air which has been compressed. Thus, wet compressed air from conduit 43 (FIGS. 1 and 3) is passed, in the direction of arrows 46, through heat exchange conduits 44 (FIG. 3) of air-to-air heat exchanger 45 and then is passed through conduit 47 leading to heat exchange conduits 49 of shell evaporator 30 where it flows in the direction of arrows 56. It then flows through conduit 50 to coalescer/separator 51 from which it passes into conduit 52 and then sinuously around baffles 53 of air-to-air heat exchanger 45 and then to conduit 54 wherein it is clean, dry, oil-free air. The air-to-air heat exchanger is a conventional device well known in the field, and it is schematically depicted in FIGS. 1 and 3.

As noted above, one aspect of the present system is that shell evaporator 30 functions as a fully flooded evaporator so that a mixture of liquid refrigerant and oil will pass into the inlet **31*a* of conduit 31, which is located at the top of shell evaporator 30 (FIG. 3), as it must be to cause shell evaporator 30 to function as a fully flooded evaporator. Thus, a mixture of liquid refrigerant and oil will pass through conduit 31 to heat exchange conduit 32 of control evaporator 15. Within control evaporator 15, which functions as a supplemental evaporator, the liquid refrigerant in conduit 32 is vaporized because of the heat exchange relationship between conduit 32 and conduit 14 which conducts hot gaseous refrigerant through control evaporator 15. Thus, the refrigerant which passes into conduit 33 will be vaporized and thus will be superheated. This superheat will be sensed by bulb 55 which is coupled to thermal expansion valve 25 by conduit 57. Thus, the thermal expansion valve 25, by sensing superheat in suction line conduit portion 33, will open to cause more liquid refrigerant to enter shell evaporator 30 and thus cause it to be fully flooded so that a mixture of liquid refrigerant and oil will pass into shell evaporator outlet 31*a***.

The control evaporator 15, in conjunction with the thermal expansion valve 25 and its control 55, provides for liquid level control in the shell evaporator 30 to cause it to function as a fully flooded evaporator to thereby provide accurate superheat control and positive oil return to the compressor at all refrigeration loads from zero to heavy overload without the necessity of prior art surge drums, recirculating systems, floats, oil return piping, oil separators or any other components. It is because the shell evaporator 30 is caused to function in fully flooded condition that there is positive oil return through conduit 31 to the compressor because the oil has to be entrained with the liquid refrigerant in order to pass from the shell evaporator 30. In other words, if shell evaporator 30 was not fully flooded and refrigerant gas passed therefrom, the oil would not be entrained in such refrigerant gas so as to return to the compressor for proper lubrication. In addition to its function of causing the shell evaporator 30 to function in fully flooded condition, the control evaporator 15 also ensures that the liquid refrigerant from conduit 31 is fully vaporized so that there is no liquid refrigerant passing into the inlet 42 of compressor 11, thereby insuring that there is no slugging or flood-back.

Figure 1A:
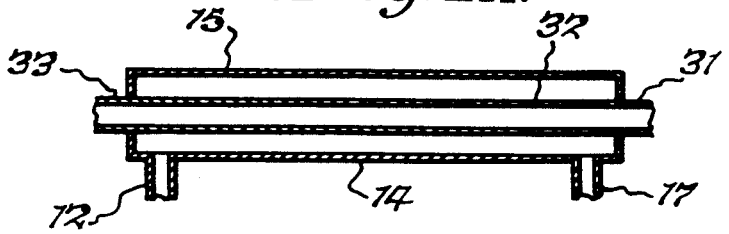
FIG. 1A is a fragmentary view of the suction line portion of the refrigeration system containing the control evaporator.

While control evaporator 15 has been depicted as utilizing hot refrigerant gas, it will be appreciated that the suction line portion 32 can be heated by any other suitable means, such as an electrical heating coil or any other suitable arrangement which will provide heat. One embodiment of the control evaporator is shown in FIG. 1A wherein it comprises a tubular conduit which encircles suction conduit portion 32. Hot gas is provided to the tubular conduit from conduit 12 and leaves through conduit 17 (FIGS. 1 and 1A). Another embodiment of the control evaporator is a shell-and-tube exchanger like the main evaporator in form but smaller, wherein the hot gas passes through the shell side and the suction gas/liquid through the tubes.

In accordance with the present invention, the compressor is selectively unloaded when it is providing too much refrigeration, while permitting it to continue running without the risk of overheating, short cycling, oil pump-out, and while providing significant power savings over other systems, such as those using discharge bypass valves.

One embodiment of the unloading system for hermetic compressor 11 is shown in FIGS. 1–5. It includes a "hot loop" consisting of solenoid valve 60 which has its inlet in communication with high pressure conduit 12 through conduit 61 and which has its outlet in communication with suction line portion 39 through conduit 62. Thus, solenoid valve 60, when open, causes hot refrigerant to flow from the outlet of compressor 11 back to the inlet of the compressor. The unloading circuit also includes a "cold loop" circuit wherein solenoid valve 63 has its inlet in communication with high pressure conduit 12 through conduit 64 and has its outlet in communication with conduit 27 leading to the inlet of evaporator 30 through conduit 65. When solenoid valve 63 is open, hot refrigerant from the outlet of compressor 11 bypasses condenser 19 and is fed directly to evaporator 30 where it is cooled. If desired, the outlet of conduit 65 can be placed in communication with conduit 31, that is, any portion of conduit 31 between the evaporator and bulb 55 and preferably before heat exchanger 15, and this is considered the outlet of the evaporator. Also, if desired, conduit 65 can be placed in communication with both the inlet and outlet of the evaporator. Solenoid valves 60 and 63 are normally closed so that refrigerant does not pass through the conduits leading to and from them unless energized.

The compressor 11 is unloaded by energizing normally closed solenoid valves 60 and 63 to an open condition whenever the temperature of the wet air leaving conduit 49 of evaporator 30 falls below the controller setting. In this respect, if the water in this air should freeze, it will clog conduits 49. Accordingly, a control arrangement is provided to prevent this from happening while permitting compressor 11 to continue running. The control arrangement includes a thermocouple 67 (FIGS. 1, 3, 4 and 5) which is inserted into the outlet portion 48 of the conduit 49, as shown in FIG. 3. More specifically, thermocouple 71 is located in the portion 48 of conduit 49 carrying air leaving shell evaporator 30 so that it is exposed to the coolest air temperature leaving the shell evaporator. Thermocouple 67 is connected by lead 69 to dew point temperature controller 70 which opens solenoid valves 60 and 63 when it is actuated. Lead 69 is sealed to evaporator 30 by a suitable seal 68. Thermocouple 67 is housed within the central portion 71 of finned member 72 and is in tight heat-conducting contact therewith. The fins 73 have their outer edges in firm heatconducting engagement with the inside of portion 48 of conduit 49 through which the cooled air leaving shell evaporator 30 passes. Thus, when there is a high air flow through the portion 48 of conduit 49, thermocouple 67 will essentially sense the temperature of the air, notwithstanding that portion 48 of conduit 49 is immersed in liquid refrigerant which fills shell evaporator 30. Alternatively, if there is a low air flow through outlet portion 48 of conduit 49, the thermocouple 67 will essentially sense the temperature of the liquid refrigerant in flooded shell evaporator 30 because this temperature is conducted through conduit 49 to thermocouple 67 by fins 73 and body portion 72 of finned member 71. In either event, the sensing of the temperature by thermocouple 67 will unload compressor 11 when the temperature at thermocouple 67 falls below a predetermined value. While a thermocouple has been shown, it will be appreciated that other types of temperature sensing devices, such as a fluid containing bulb, can be placed in central portion 71 and in tight heat-conducting relationship therewith.

The unloading of compressor 11 is effected in the following manner. Normally, solenoid valves 60 and 63 are closed. When the system is placed in operation by closing switch 75 (FIG. 2), relay 77 is energized to close contacts 79 and thus actuate compressor 11. Also at this time suction line solenoid 37 is opened to maintain the suction line open as long as the compressor 11 is in operation. When the system is first started up, the temperature of air in conduit 49 will be above a predetermined value and solenoid valves 60 and 63 will remain closed, thus causing the refrigerant provided by compressor 11 to pass through the control evaporator 14, condenser 19, thermal expansion valve 25, flooded evaporator 30, and the suction lines back to the compressor. There will be no flow through the branches in which solenoid valves 60 and 63 are located. This condition will persist while the compressor 11 is loaded sufficiently so that the temperature sensed by thermocouple 67 remains above a predetermined value. However, if the load should drop, the temperature in portion 48 of conduit 49 will fall below the controller setting temperature. This in turn requires that compressor 11 be unloaded so that the system will cease to provide refrigeration, and this is accomplished while permitting compressor 11 to continue in operation. More specifically, when thermocouple 67 senses the temperature drop below a predetermined value, it will actuate dew point temperature controller 70, which in turn causes contacts C3 to close, thereby energizing solenoid valve 60 and solenoid valve 63 to thereby open both of these valves. Solenoid valve 60 can be energized because switch 83 is normally closed. When solenoid valve 60 is opened, hot gas from conduit 12 will pass into suction line portion 39 and back to the compressor, thereby causing unloading in this respect. However, this aspect of the unloading may cause the compressor to overheat because hot gaseous refrigerant is being passed back to it. In order to compensate for this, the opening of solenoid valve 63 will cause hot refrigerant gas to pass from conduit 12 to the inlet of shell evaporator 30 and thus pass through the shell evaporator, the control evaporator 15, and into portion 33 of the suction line. The gas thus passing from solenoid valve 63 through the shell evaporator will be cooled and this cooled gas will mingle in conduit 39 with the hot gas emanating from solenoid valve 60 of the hot loop and thus provide unloading without causing the compressor to overheat. At this point it is to be noted that there is a sensing bulb 84 (FIG. 1) on suction line portion 41, and it is in communication with thermostat 85 (FIGS. 1 and 2) through lead 87. Sensing bulb 84 contains fluid which changes volume in response to temperature changes, but other types of sensing means can be used. When this thermostat senses the suction line temperature in conduit 41 to be above a predetermined value, thermostat 85 will open switch 83 to thereby deenergize solenoid valve 60 and cause it to close, thereby causing the unloading to be effected only through the cold loop because at this time solenoid valve 63 remains open. When the temperature of the refrigerant in suction line portion 41 falls below a predetermined value, sensing bulb 84 will again cause thermostat 85 to close switch 83 to again cause solenoid valve 60 to open to thereby again place the hot loop in the circuit. Check valve 13 in line 12 prevents backflow of liquid refrigerant from condenser 19 and control evaporator 15 when solenoid valve 60 is open.

Figure 6:
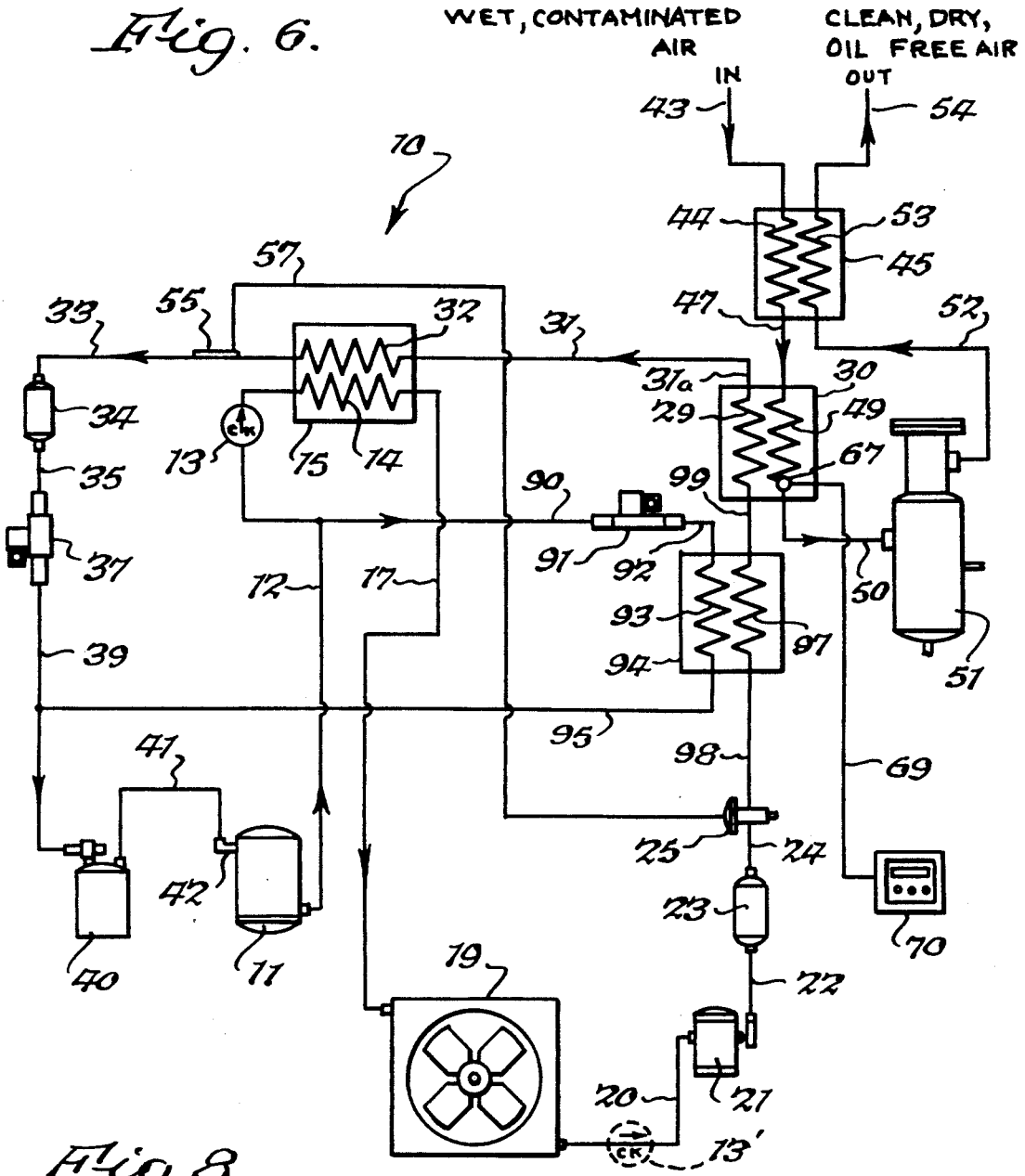
FIG. 6 is a schematic view of a refrigeration system which includes a preferred embodiment of an unloading system for the compressor utilizing a loop having an auxiliary evaporator therein for passing hot gas from the compressor outlet to its inlet.
Figure 8:
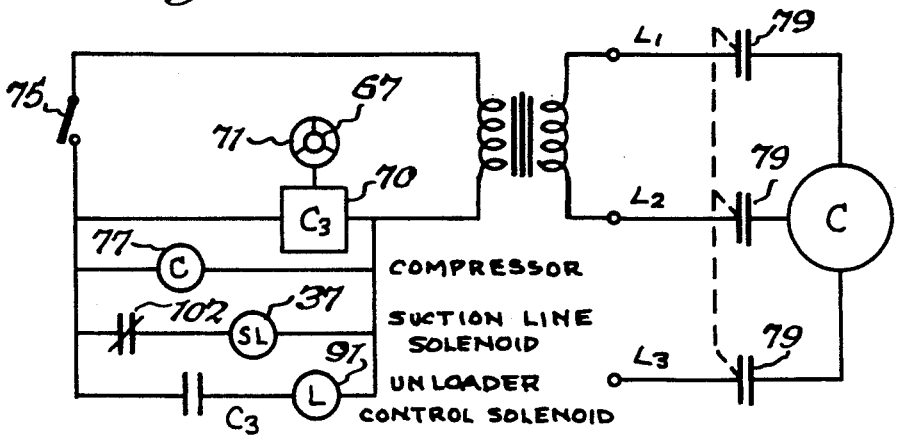
FIG. 8 is a schematic electrical diagram for unloading the compressor in the system of FIG. 6.
Figure 7:
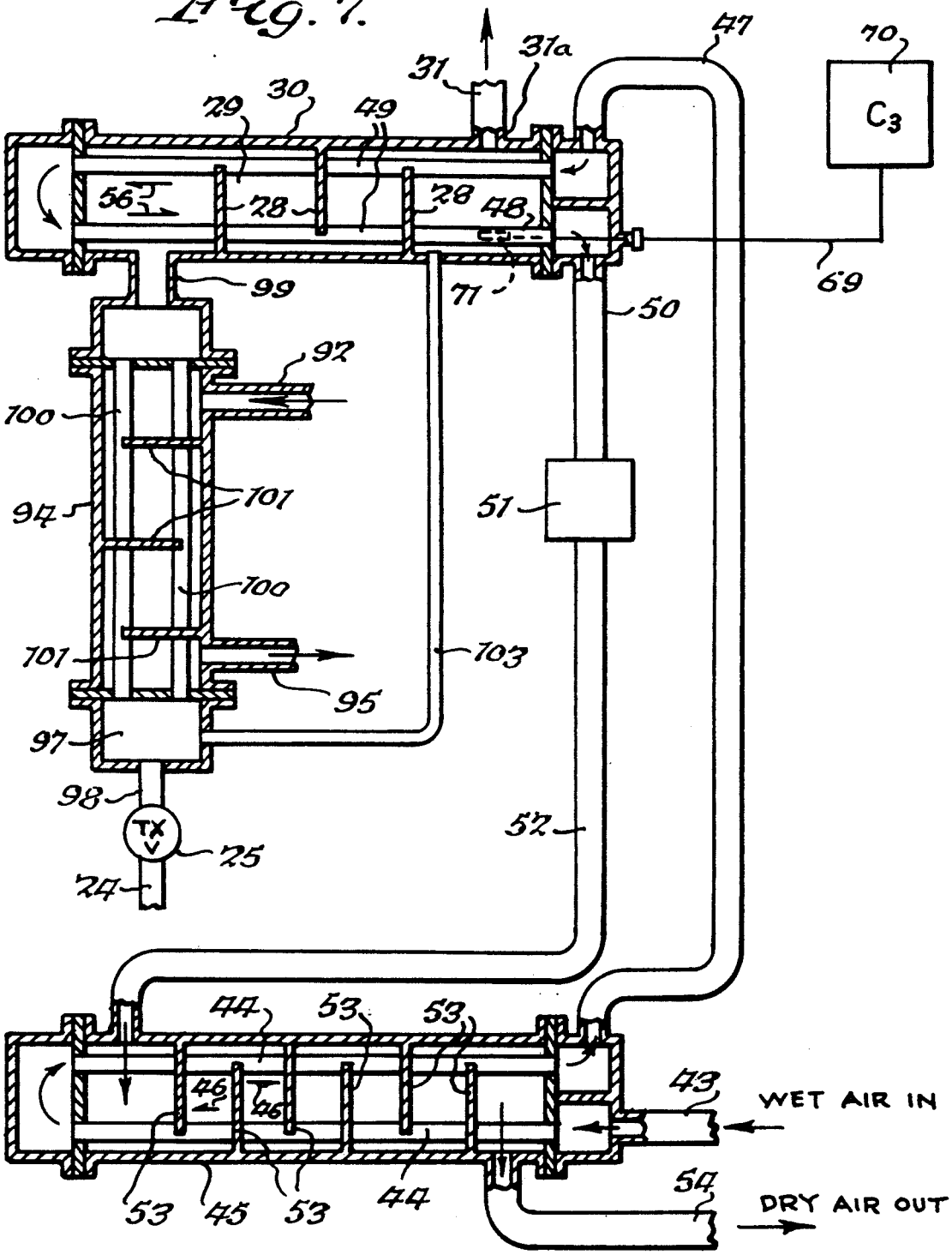
FIG. 7 is a fragmentary cross sectional view of the auxiliary evaporator in the system of FIG. 6.

In accordance with the preferred embodiment of the present invention, which is shown in FIGS. 6–8, the compressor 11 is selectively unloaded when it is providing too much refrigeration, while permitting it to continue running without the risk of overheating, short cycling, oil pump-out, and without the flow of liquid refrigerant back to the compressor, while providing significant power savings over other systems, such as those using discharge bypass valves. The unloading system of FIGS. 1-5 operates as intended with evaporators smaller than about eight inches in diameter. However, it has been observed that in larger evaporators, or where there is no control evaporator to gasify the liquid refrigerant, the hot gas in the cold loop of FIGS. 1-5 sweeps liquid refrigerant out of the evaporator and into the suction accumulator or compressor, risking serious oil dilution in the compressor. The preferred embodiment of FIGS. 6-8 avoids the foregoing problem. The numerals of FIGS. 6-8 which are the same as the numerals of FIGS. 1-6 denote identical elements of structure.

The unloading system of FIGS. 6-8 for hermetic compressor 11 includes a refrigerant loop consisting of conduit 12, conduit 90, solenoid valve 91, conduit 92, inside conduit structure 93 in auxiliary evaporator or static cooler 94, conduit 95, suction line 39, suction accumulator 40, and conduit 41, which is in communication with the compressor inlet 42. Auxiliary evaporator 94 is essentially a heat exchanger which is located underneath the main evaporator 30 so that liquid refrigerant gravitates into inside conduit structure 97 thereof and the gas generated in inside conduit 97 returns to the inside 29 in the main evaporator. Additionally, there may be added a liquid feed or "equalizer" tube 103 connected between the end of evaporator shell 30 which is opposite the end to which the static cooler 94 is attached and chamber 97 of said static cooler 94, to facilitate the feed of liquid into that cooler. The heat exchange between conduit structures 93 and 97 cools the hot gas in conduit 93 without actual contact of the refrigerants therein. The suction line valve 37 is closed during unloading, as set forth in detail hereafter. Auxiliary evaporator 94 (FIGS. 6 and 7) is a small copper shell and tube heat exchanger which hangs on the bottom of shell evaporator 30 and is in communication with inside 29 thereof through conduit 99. The main flow of liquid refrigerant is through auxiliary evaporator 94 from conduit 98 and it passes through the inside conduit structure 97 thereof which includes heat exchange conduits 100. During unloading the hot gas from conduit 92 passes around baffles 101 in conduit structure 93 and out through conduit 95, without contacting the primary refrigerant in the inside of conduit structure 97 of auxiliary evaporator 94. Thus, solenoid valve 91, when open, causes hot refrigerant to flow from the outlet of compressor 11 back to the inlet of the compressor through the auxiliary evaporator 94 without mingling with the refrigerant in the main evaporator 30. Normally solenoid valve 91 is closed so that refrigerant does not pass through the conduits leading to and from it and the refrigerant flow from the compressor is through the control evaporator 15, conduit 17, condenser 19, conduit 20, receiver 21, conduit 22, dryer 23, conduit 24, thermal expansion valve 25, conduit 98, conduit 97 of auxiliary evaporator 94, conduit 29 of main evaporator 30, and the remainder of the parts of the refrigeration system downstream of the main evaporator, as set forth above relative to FIGS. 1-5.

The compressor 11 is unloaded by energizing normally closed solenoid valve 91 to an open condition whenever the temperature of the wet air leaving conduit 49 of evaporator 30 falls below the controller setting. In this respect, if the water in this air should freeze, it will clog conduit 49. Accordingly, the control arrangement of FIG. 8 is provided to prevent this from happening while permitting compressor 11 to continue running. The control arrangement includes a thermocouple 67 of FIG. 8, which is also shown in FIGS. 1, 3, 4 and 5, which is inserted into the outlet portion 48 of the conduit 49, as shown in FIG. 3. A detailed description of the control means for operating the unloader and its relationship to the remainder of the system was given above and is incorporated at this point by reference.

Figure 2:
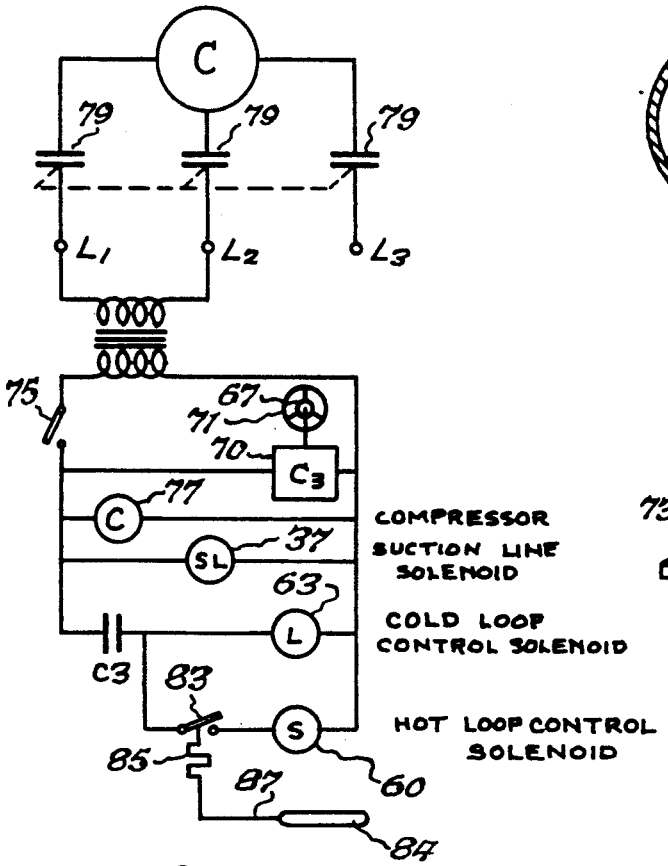
FIG. 2 is an abbreviated electrical schematic diagram for the system of FIG. 1 and showing especially the compressor unloading structure.
Figure 5:
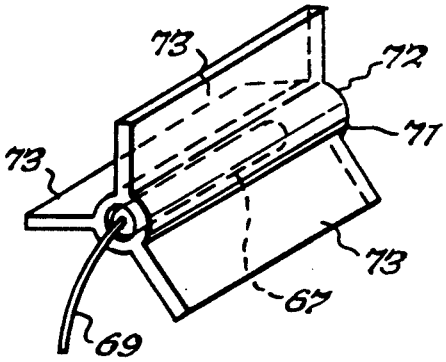
FIG. 5 is a fragmentary perspective view of the plug with the thermocouple therein.

The unloading of compressor 11 is effected in the following manner, as discussed relative to FIG. 8 wherein numerals which are indentical to those of FIG. 2 denote identical elements of structure. Normally, solenoid valve 91 is closed. When the refrigeration system is initially placed in operation by closing switch 75 (FIG. 8), relay 77 is energized to close contacts 79 and thus actuate compressor 11. Also at this time suction line solenoid 37 is opened to maintain the suction line open as long as the compressor 11 is in operation except when the compressor is being unloaded. When the system is first started up, the temperature of air in conduit 49 will be above a predetermined value and solenoid valve 91 will remain closed, thus causing the refrigerant provided by compressor 11 to pass through the control evaporator 14, condenser 19, thermal expansion valve 25, internal conduit structure 97 of auxiliary evaporator 94, flooded evaporator 30, and the suction lines back to the compressor. There will be no flow through the loop in which solenoid valve 91 is located. This condition will persist while the compressor 11 is loaded sufficiently so that the temperature sensed by thermocouple 67 remains above a predetermined value.

As noted above relative to FIGS. 1-5, if the temperature sensed by thermocouple 67 should drop below the predetermined value, this means that it senses a temperature in portion 48 of conduit 49 which falls below the controller setting temperature. This in turn requires that compressor 11 be unloaded so that the system will cease to provide refrigeration, and this is accomplished while permitting compressor 11 to continue in operation. More specifically, when thermocouple 67 senses the temperature drop below a predetermined value, it will actuate dewpoint temperature controller 70, which in turn causes normally open contacts C3 to close, thereby energizing solenoid valve 91 to thereby open this valve. At this time, normally closed contacts 102 will open to cause solenoid valve 37 to close. When solenoid valve 91 is opened, hot gas from conduit 12 will pass through auxiliary evaporator 94, into suction line portion 39 downstream of solenoid valve 37, and back to the compressor, thereby causing unloading in this respect. In passing through the auxiliary evaporator 94, the hot gas is cooled. More specifically, hot gas from the compressor will flow through conduits 12 and 90, solenoid valve 91, auxiliary evaporator internal conduit structure 93, conduit 95, conduit 39, suction accumulator 40, and conduit 41. Check valve 13 in line 12 prevents backflow of liquid refrigerant from condenser 19 and control evaporator 15 when solenoid valve 91 is open.

The improved unloading system of FIGS. 6-8 has numerous advantages. One advantage is that the liquid in the main evaporator 30 is not exposed to the flow of hot gases in auxiliary evaporator 94 and thus cannot enter the internal conduit structure 97 of the auxiliary evaporator, thereby obviating the possibility of carrying liquid refrigerant back to the compressor through conduit 95. Furthermore, the volume of refrigerant vapor caught in the bypass loop during bypass is so small so that no significant condensation and floodback to the compressor can occur. Also, due to heat interchange in the auxiliary evaporator 94, there is heat which is transferred to the large volume of cold liquid in the main evaporator 30. This causes the refrigerant in the main evaporator to warm up and the control means 70 to cause the system to periodically resume refrigeration even though there is no external load on the refrigeration system. Therefore, the system cannot "use up the cold" stored in the evaporator, and thus cool compressor operation continues indefinitely. In other words, the compressor cannot be overheated because the return gas in the loop is always assured of being cooled. Another advantage is that because of the low volume of refrigerant in the bypass loop, the loop pressure remains lower than in the system of FIGS. 1-5 in utilizing both a hot loop and a cold loop, thereby causing economy of unloaded operation to increase slightly and further reducing wear on the parts. Also, the cycling rate of the unloading system is greatly reduced over the hot loop and cold loop system of FIGS. 1-5, thereby reducing wear on the solenoid valves to the point that special rapid cycle valves are not required. Also, because the heat exchange is entirely within the refrigeration system, the control of the loop temperature is maintained within safe limits even in an ambient temperature which may be too high for normal operation.

While the present application has referred to a halocarbon refrigeration system, it will be appreciated that it need not be restricted thereto, but the various aspects of the present disclosure may be used with refrigeration systems utilizing other types of refrigerants such as ammonia, carbon dioxide or other materials which can be transformed between gaeous and liquid phases.

It can thus be seen that the improved refrigeration system of the present invention is manifestly capable of achieving the above enumerated objects, and while preferred embodiments of the present invention have been disclosed, it will be appreciated that it is not limited thereto but may be otherwise embodied within the scope of the following claims.

What is claimed is:

1. A refrigeration system comprising a compressor having a compressor outlet and an inlet, a condenser, first conduit means coupling said compressor outlet to said condenser, an evaporator, second conduit means coupling said condenser to said evaporator, refrigerant expansion means in said second conduit means, third conduit means coupling said evaporator to said inlet of said compressor, refrigerant and oil circulated through said system by said compressor, and unloading means for unloading said compressor without overheating while permitting it to continue running, said unloading means comprising fourth conduit means coupled between said first conduit means and said compressor inlet for passing hot gas from said compressor back to said compressor inlet, cooling means for cooling said hot gas in said fourth conduit means to thereby cool said hot gas passing into said compressor inlet from said fourth conduit means, and control means for selectively effecting passage of gases from said compressor through said fourth conduit means in response to the necessity for unloading said compressor to cause said refrigeration system to stop producing refrigeration, said cooling means comprising means for placing said hot gas in said fourth conduit means in heat exchange relationship with liquid refrigerant which also flows through said evaporator.

2. A refrigeration system as set forth in claim 1 wherein said cooling means comprises an auxiliary evaporator which receives liquid refrigerant from said evaporator.

3. A refrigeration system as set forth in claim 2 wherein said auxiliary evaporator means is located below said evaporator so that liquid from said evaporator fills said auxiliary evaporator and gas generated in said auxiliary evaporator returns to said evaporator.

4. A refrigeration system as set forth in claim 3 including a liquid feed tube connected between said evaporator and said auxiliary evaporator means.

5. A refrigeration system as set forth in claim 1 including a receiver in said second conduit means, and check valve means in one of said first and second conduit means between said receiver and said fourth conduit means.

6. A refrigeration system as set forth in claim 2 wherein said auxiliary evaporator means is physically located below said evaporator, and wherein said auxiliary evaporator means includes liquid refrigerant conduit means in series relationship between said second conduit means and said evaporator whereby all refrigerant flowing through said evaporator must flow through said refrigerant conduit means in said auxiliary evaporator, and wherein said fourth conduit means includes fifth conduit means in series therewith within said auxiliary evaporator in heat exchange relationship with said liquid refrigerant conduit means.

7. A refrigeration system as set forth in claim 6 including a liquid feed tube connected between said evaporator and said auxiliary evaporator means.

8. A refrigeration system comprising a hermetic compressor having a compressor inlet, a condenser, first conduit means coupling said hermetic compressor to said condenser, an evaporator having an inlet and an outlet, second conduit means coupling said condenser to said evaporator, refrigerant expansion means in said second conduit means, third conduit means coupling said evaporator to said inlet of said hermetic compressor, refrigerant and oil circulated through said system by said compressor, and unloading means for unloading said hermetic compressor without overheating while permitting it to continue running, said unloading means comprising fourth conduit means coupled between said first conduit means and said compressor inlet for passing hot gas from said hermetic compressor directly back to said hermetic compressor, and fifth conduit means coupled from said first conduit means to at least one of said inlet and outlet of said evaporator to cause hot gas from said first conduit means to be cooled after passage from said fifth conduit means to thereby cool said hot gas passing into said compressor inlet from said fourth conduit means, and control means for selectively effecting passage of gases from said compressor through said fourth and fifth conduit means in response to the necessity for unloading said compressor to cause said refrigeration system to stop producing refrigeration.

9. A refrigeration system as set forth in claim 8 including a receiver in said second conduit means, and check valve means in one of said first and second conduit means between said receiver and said fourth and fifth conduit means.

10. A refrigeration system as set forth in claim 8 including normally closed first valve means in said fourth conduit means, and second normally closed valve means in said fifth conduit means, said control means selectively opening said first and second valve means in response to the load falling below a predetermined value.

11. A refrigeration system as set forth in claim 10 including second control means for sensing the temperature of refrigerant in said third conduit means and selectively closing said first valve means in response to said temperature exceeding a predetermined value.

12. A refrigeration system as set forth in claim 10 wherein said first and second valves are solenoid valves.

13. A refrigeration system as set forth in claim 12 including a receiver in said second conduit means, and check valve means in one of said first and second conduit means between said receiver and said fourth and fifth conduit means.

14. A refrigeration system as set forth in claim 8 wherein said evaporator is a shell evaporator, and wherein said refrigerant expansion means comprises a thermal expansion valve, second control means on said third conduit means coupled to said thermal expansion valve for effecting control thereof in response to the temperature of refrigerant in said third conduit means, and heating means for heating said third conduit means between said evaporator and said second control means to cause the heating of refrigerant in said third conduit means to cause said second control means to cause said thermal expansion valve to admit greater amounts of refrigerant to said shell evaporator than if heated refrigerant was not sensed by said second control means to thereby cause said shell evaporator to operate in a flooded condition and thus cause a mixture of liquid refrigerant and oil to flow into said third conduit means from said shell evaporator, said heating means causing vaporization of said liquid refrigerant in said third conduit means to ensure passage of a mixture of oil and gaseous refrigerant to said compressor.

15. A refrigeration system as set forth in claim 14 wherein said heating means comprises heat exchange means for conducting hot gas from said compressor in heat exchange relationship with refrigerant and oil in said third conduit means.

16. A refrigeration system as set forth in claim 15 wherein said heat exchange means comprises a conduit surrounding said third conduit means and located in series in said first conduit means.

17. A refrigeration system as set forth in claim 8 wherein said evaporator is a shell evaporator wherein a fluid passing conduit for passing fluid is immersed in refrigerant in said shell evaporator, and wherein said control means comprises a finned tube in said fluid passing conduit having a central tubular portion and fin means extending outwardly therefrom in heat conducting contact with the inside of said fluid passing conduit, and a thermocouple in said central tubular portion and in heat conducting relationship therewith to thereby cause said thermocouple to sense the temperature of said fluid in said fluid passing conduit when relatively high flows of said fluid are experienced and for sensing the temperature of said refrigerant when relatively low flows of said fluid are experienced, said control means effecting said unloading when said temperature of said fluid in said fluid passing conduit falls below a predetermined value.

18. A refrigeration system as set forth in claim 17 including a receiver in said second conduit means, and check valve means in one of said first and second conduit means between said receiver and said fourth and fifth conduit means.

19. A refrigeration system as set forth in claim 17 including normally closed first valve means in said fourth conduit means, and second normally closed valve means in said fifth conduit means, said control means selectively opening said first and second valve means in response to the load falling below a predetermined value.

20. A refrigeration system as set forth in claim 19 including second control means for sensing the temperature of refrigerant in said third conduit means and selectively closing said first valve means in response to said temperature exceeding a predetermined value.

21. A refrigeration system as set forth in claim 19 wherein said first and second valves are solenoid valves.

22. A refrigeration system as set forth in claim 19 including a receiver in said second conduit means, and check valve means in said first conduit means between said receiver and said fourth and fifth conduit means.

* * * * *